US006111741A

United States Patent [19]

Schmitz et al.

[11] Patent Number: 6,111,741

[45] Date of Patent: Aug. 29, 2000

[54] MOTION RECOGNITION PROCESS, IN PARTICULAR FOR REGULATING THE IMPACT SPEED OF AN ARMATURE ON AN ELECTROMAGNETIC ACTUATOR, AND ACTUATOR FOR CARRYING OUT THE PROCESS

[75] Inventors: Günter Schmitz, Aachen; Lutz Kather, Wüselen, both of Germany

[73] Assignee: FEV Motorentechnik GmbH & Co., Aachen, Germany

[21] Appl. No.: 09/171,901

[22] PCT Filed: Feb. 25, 1998

[86] PCT No.: PCT/EP98/01053

§ 371 Date: May 11, 1999

§ 102(e) Date: May 11, 1999

[87] PCT Pub. No.: WO98/38656

PCT Pub. Date: Sep. 3, 1998

[30] Foreign Application Priority Data

Feb. 28, 1997 [DE] Germany ..... 297 03 587 U

[51] Int. Cl.[7] ..... H01F 7/18

[52] U.S. Cl. ..... 361/143; 361/160; 361/154

[58] Field of Search ..... 361/152–156, 361/160, 143

[56] References Cited

U.S. PATENT DOCUMENTS

| | | | |
|---|---|---|---|
| 3,671,814 | 6/1972 | Dick | 361/154 |
| 4,434,450 | 2/1984 | Gareis | 361/152 |
| 4,812,062 | 3/1989 | Ishinaga | 361/153 |

FOREIGN PATENT DOCUMENTS

| | | |
|---|---|---|
| 195 31 435 | 2/1997 | Germany . |
| 62-222607 | 9/1987 | Japan . |
| 2 293 244 | 3/1996 | United Kingdom . |

*Primary Examiner*—Fritz Fleming
*Attorney, Agent, or Firm*—Venable; Gabor J. Kelemen

[57] ABSTRACT

Motion recognition processes are disclosed, in particular for regulating the impact speed of an armature on an electromagnetic actuator with at least one electromagnet having at least one pole face (4) and connected to a controllable power supply, and with an armature (5) connected to a regulating element to be actuated which when power is supplied to the electromagnet, is moved against the force of a restoring spring (7) in the direction of the pole face of the electromagnet from a first switching position to a second switching position in which it stops against the pole face. At least one sensor (11) detects in a defined air gap zone of the pole face a progressive attenuation of the magnetic field as the armature approaches and generates a corresponding signal.

9 Claims, 7 Drawing Sheets

Figure 1:
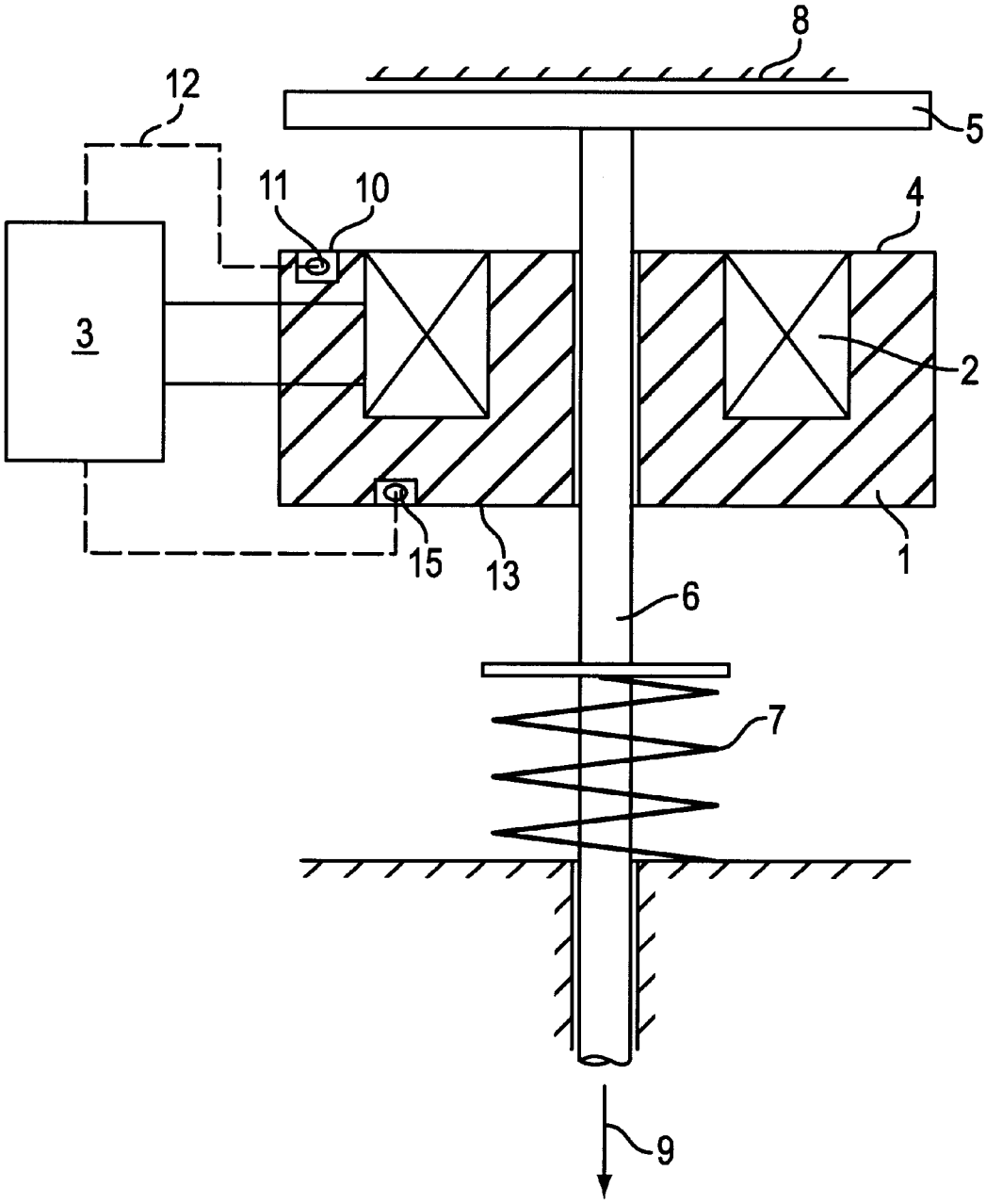

MOTION RECOGNITION PROCESS, IN PARTICULAR FOR REGULATING THE IMPACT SPEED OF AN ARMATURE ON AN ELECTROMAGNETIC ACTUATOR, AND ACTUATOR FOR CARRYING OUT THE PROCESS

SPECIFICATION

Electromagnetic actuators, essentially consisting of at least one electromagnet and an armature connected with the servo component to be actuated which, when supplied with current, can be moved against the force of a restoring spring, have high switching speeds. However, a problem arises in that in the course of the armature approach, as the distance from the pole face of the electromagnet, that is, as the air gap between the pole face and the armature becomes smaller, magnetic force acting on the armature rises progressively, while the counter force of the restoring spring as a rule increases only linearly, so that the armature strikes the pole face with increasing speed. Along with the attendant noise, recoiling can occur; that is, the armature first meets the pole face but then bounces away at least briefly until it finally comes to rest on it. This can cause impairments in the function of the regulating element, which particularly in actuators with a high switching frequency can cause considerable problems.

It is therefore desirable if the impact speeds are on the order of magnitude of less than 0.1 m/s. It is important in this respect that such low impact speeds be assured under actual operating conditions as well, with all the associated stochastic fluctuations of such conditions. Disturbances from outside, such as jarring or the like, can cause a sudden drop in the final approach phase or even after the armature contacts the pole face.

From German Patent Disclosure DE-A 41 29 265, an electromagnetic switch gear is known which has a magnet core with a switching armature. The magnet core is provided on its outside with a magnetic flux sensor, which is interconnected with an electronic regulating device in such a way that the electric power supplied to the coil is regulated in proportion to the magnetic flux. In this switch gear, the magnetic flux, which increases when the switching armature contacts the pole face, is detected via the sensor, so that during the time while the switching armature is retained against the pole face, the current supply can be reduced to reduce the electrical power loss.

From German Patent Disclosure DE-A 36 37 133, an electromagnetic switch device is known, which has a magnetic flux sensor, disposed separately from the magnet core, and a soft iron piece oriented parallel to the active magnetic field between the magnet core and the switching armature. Via this soft iron piece, the stray field that exists between the switching armature and the pole face when the switching armature is open is oriented in a targeted way, so that the sensor disposed between the magnet core and the soft iron piece can detect the fact of a magnetic flux. As soon as the switching armature contacts the pole face, this stray field is practically eliminated, so that no magnetic flux whatever is detected by the sensor. With the aid of this arrangement, the intent is merely to monitor the contact of the armature on the magnet core during the holding phase, since the sensor already responds if the switching armature lifts up even slightly from the pole face, in response to external factors or if the current to the coil is too low. With this system, only an actual state, that is, the contact of the switching armature on the pole face, can be monitored.

A comparable apparatus for monitoring the actual state, that is, the contact of the armature on the pole face of an electric switching magnet during the holding phase, is known from JP-Abstract E-592, Mar. 23, 1988, Vol. 12, No. 89. In this arrangement, the pole faces are provided with a recess, in each of which one magnetic flux sensor is placed.

The object of the invention is to create a regulating process which makes it possible in an electromagnetic actuator of the type described above, to recognize the motion of the armature on its approach to the pole face, but in particular to carry the armature to its seat on the pole face at low impact speed, yet an adequate holding force after the impact of the armature on the pole face must also exist.

According to the invention, this object is attained by a process for motion recognition, in particular for regulating the impact speed on an electromagnetic actuator, having at least one electromagnet, which has at least one pole face and is connected to a controllable power supply and which has an armature that is connected to a regulating element to be actuated, which regulating element upon supply of current to the electromagnet is guided movably counter to the force of a restoring spring out of a first switching position in the direction of the pole face of the electromagnet into a second switching position defined by the contact with the pole face, wherein via at least one sensor in a defined air gap zone of the pole face, an attenuation of the magnetic field that occurs upon increasing approach of the armature is detected, and a control signal is generated. It is especially expedient here if the current supply to the electromagnet is reduced as a function of the control signal indicating the increasing attenuation of the magnetic field.

The process of the invention makes use of the surprising discovery that as the armature increasingly approaches the pole face, the magnetic flux in a defined air gap zone of the pole face becomes less and less in the air gap zone. This is because of the increasing distortion of the magnetic flux, which to an ever-decreasing extent penetrates the sensor disposed in the air gap zone. This distortion of the magnetic flux and the attendant attenuation of the magnetic flux in the air gap zone becomes all the more pronounced the less the distance of the armature from the pole face.

The term "defined air gap zone" means a limited region located in the pole face, in which region an air gap of predetermined size still remains even when the armature is contacting the pole face. This air gap may be embodied as a recess in the pole face and/or as a recess in the armature. However, the defined air gap zone must be largely surrounded by the pole face, so that there is a large enough area for a direct passage of the magnetic flux through the armature and the pole face.

Thus in the final phase of armature motion, a very sensitive, accurate signal regarding the armature position is available; this signal provides more than merely a statement about the spacing of the armature from the pole face as a function of time. This signal can be used not merely for measurement or diagnostic purposes but also, in a preferred application, offers the opportunity of switching this signal to the control unit for supplying current to the electromagnet, and by varying the current supply of also reducing the impact speed in the region closed to the pole face. Thus by suitably reducing the current level in the coil, for instance, it is possible to reduce the magnetic force acting on the armature and thus, as a consequence of the contrary action of the restoring spring, to reduce the impact speed of the armature on the pole face accordingly.

Features of the process and an actuator for carrying out the process are defined by the dependent claims.

Figure 2:
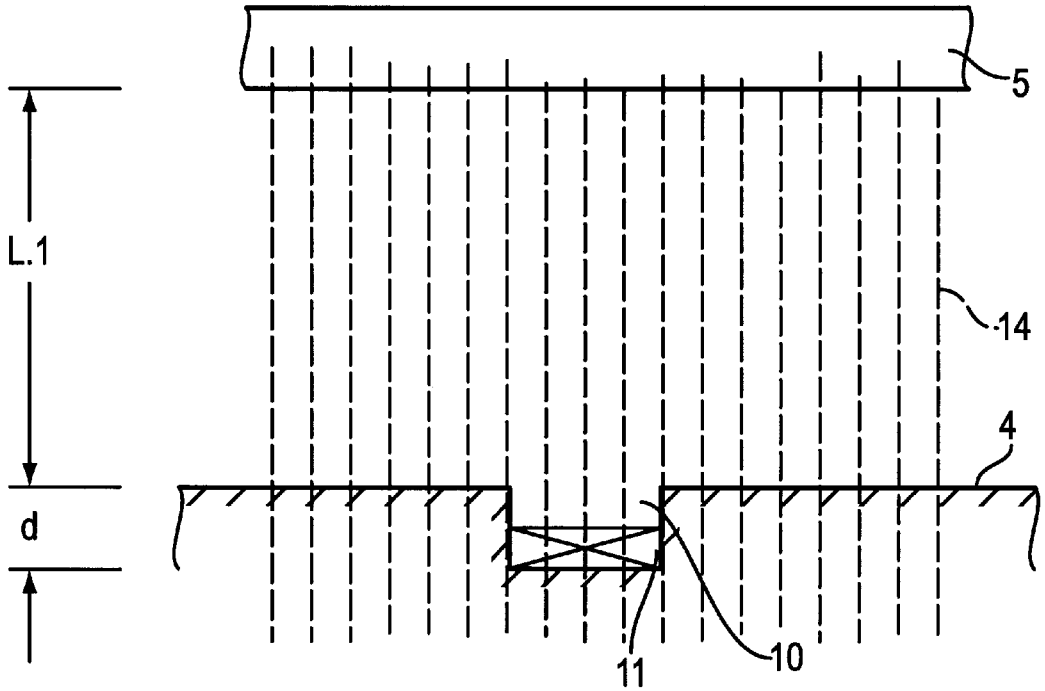
Figure 3:
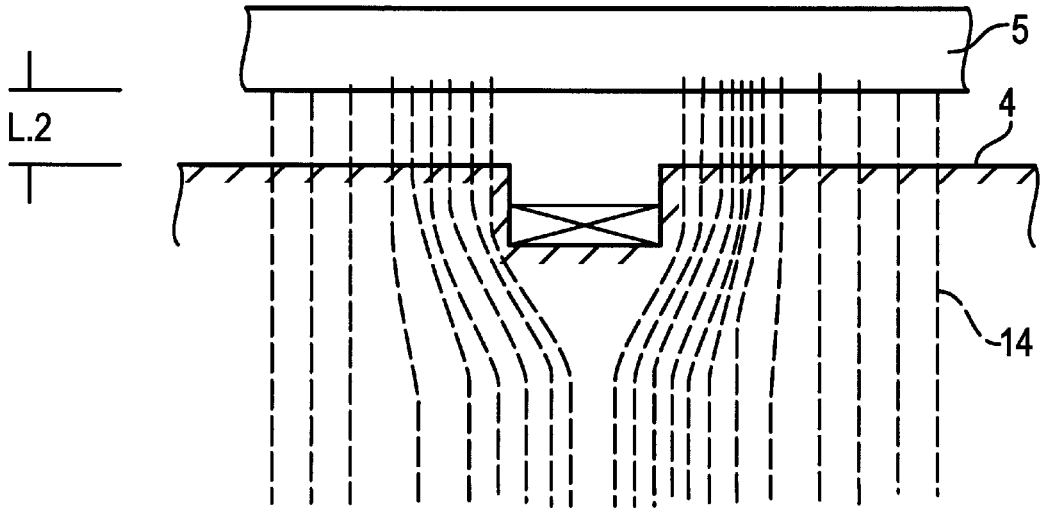
Figure 4:
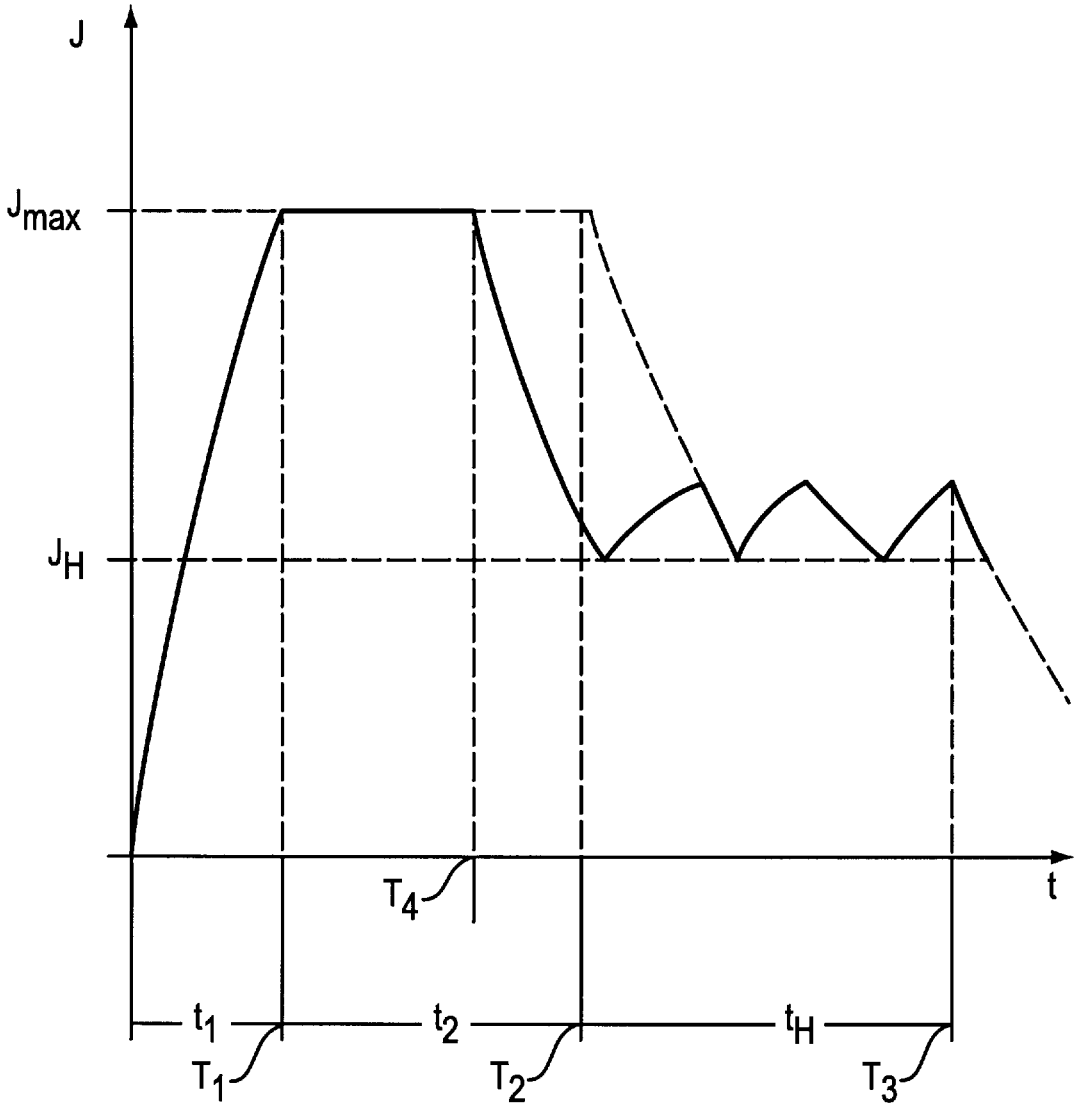
Figure 5:
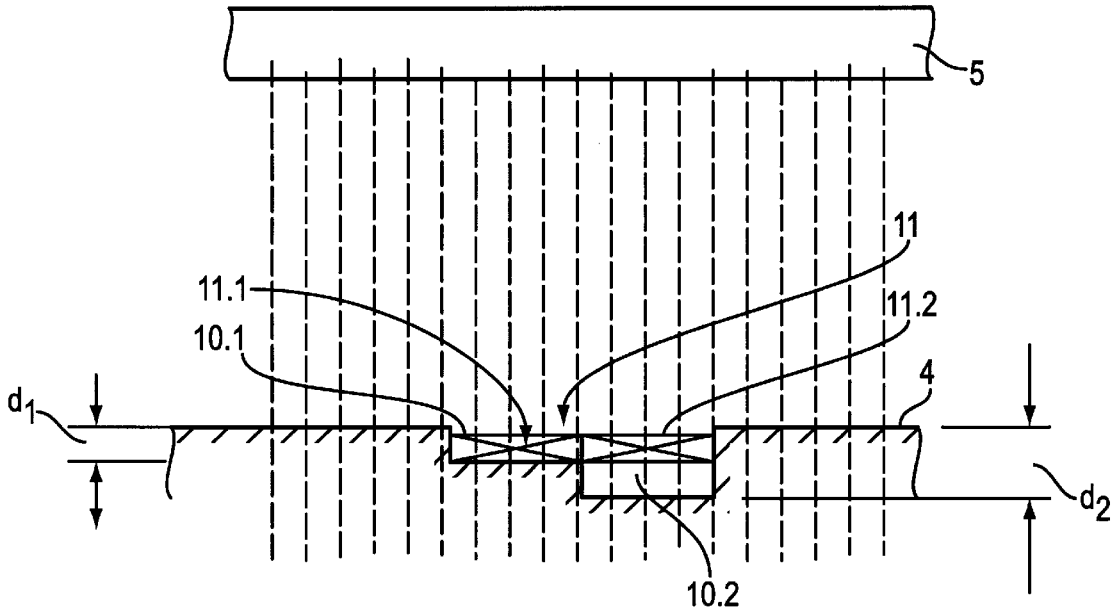
Figure 6:
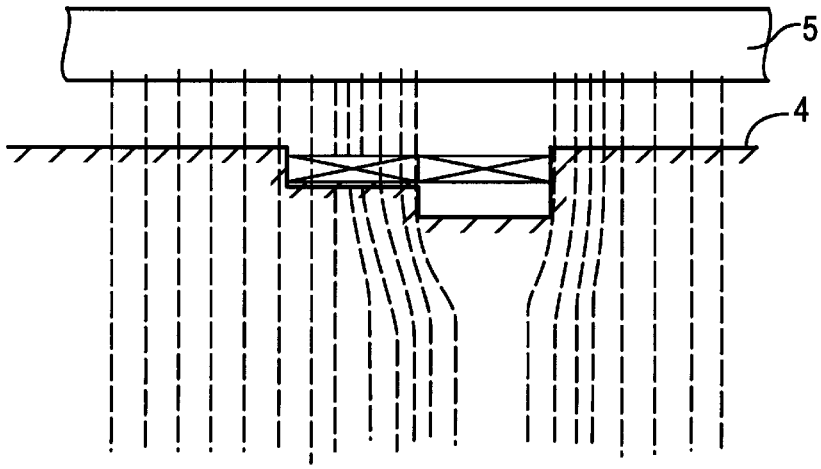
Figure 7:
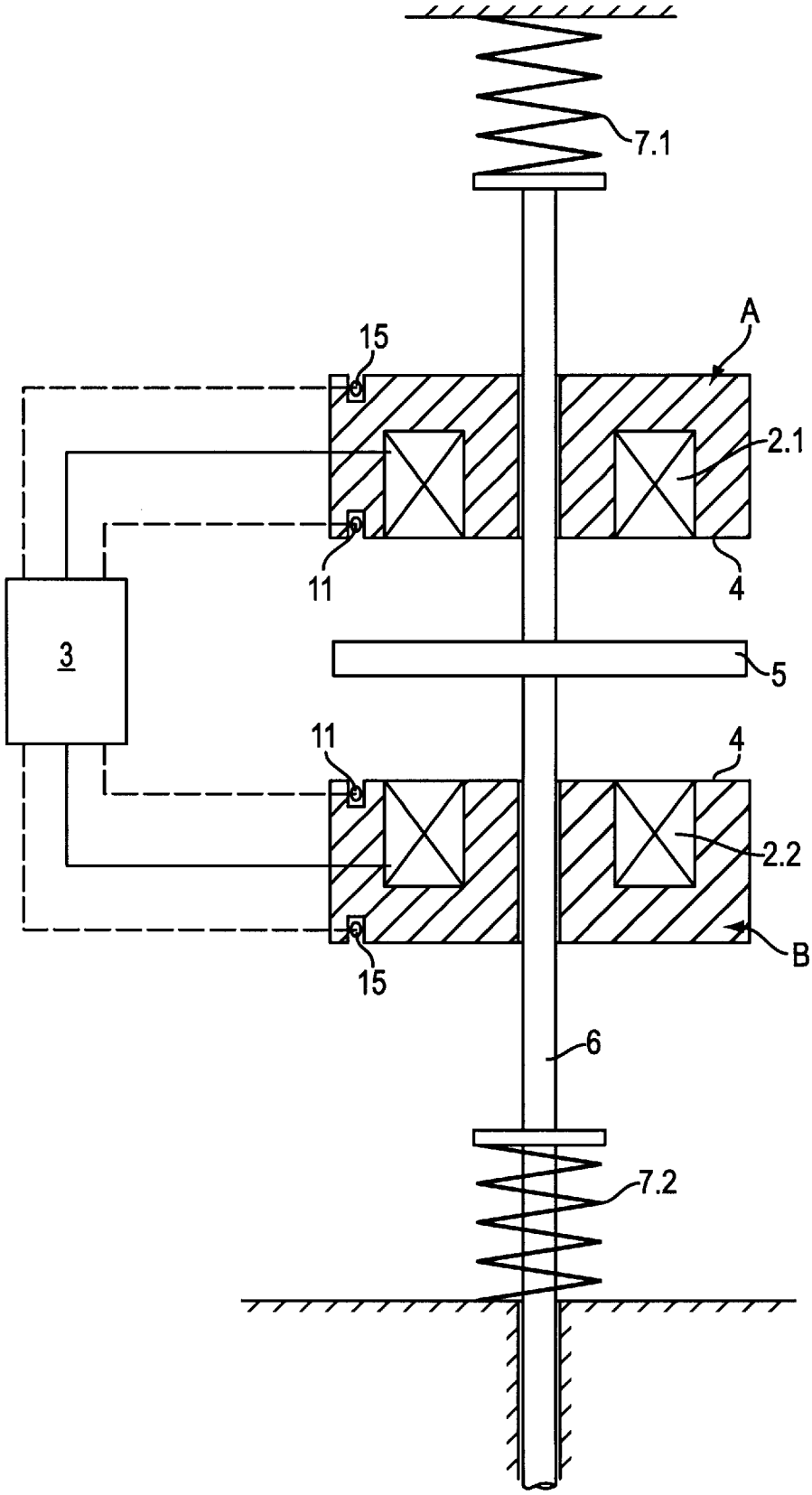
Figure 8:
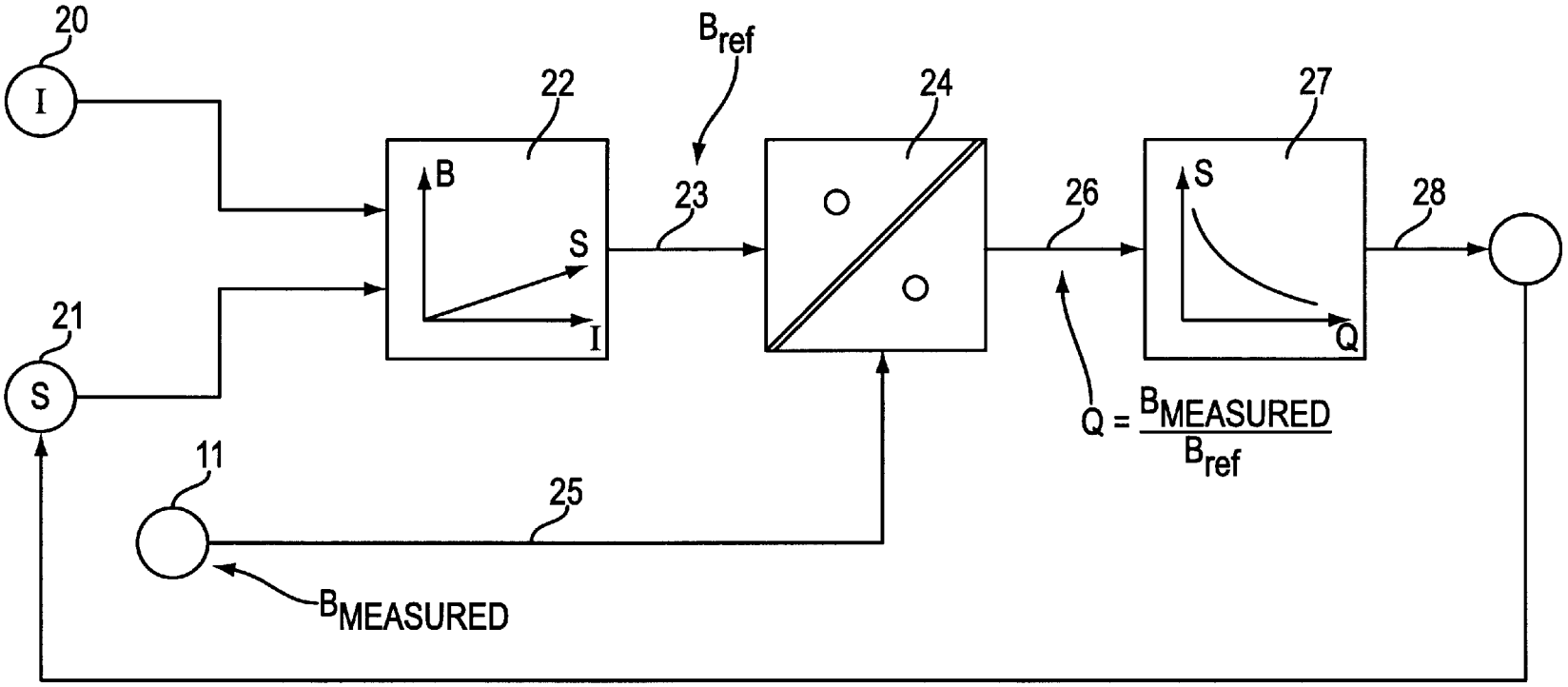
Figure 9:
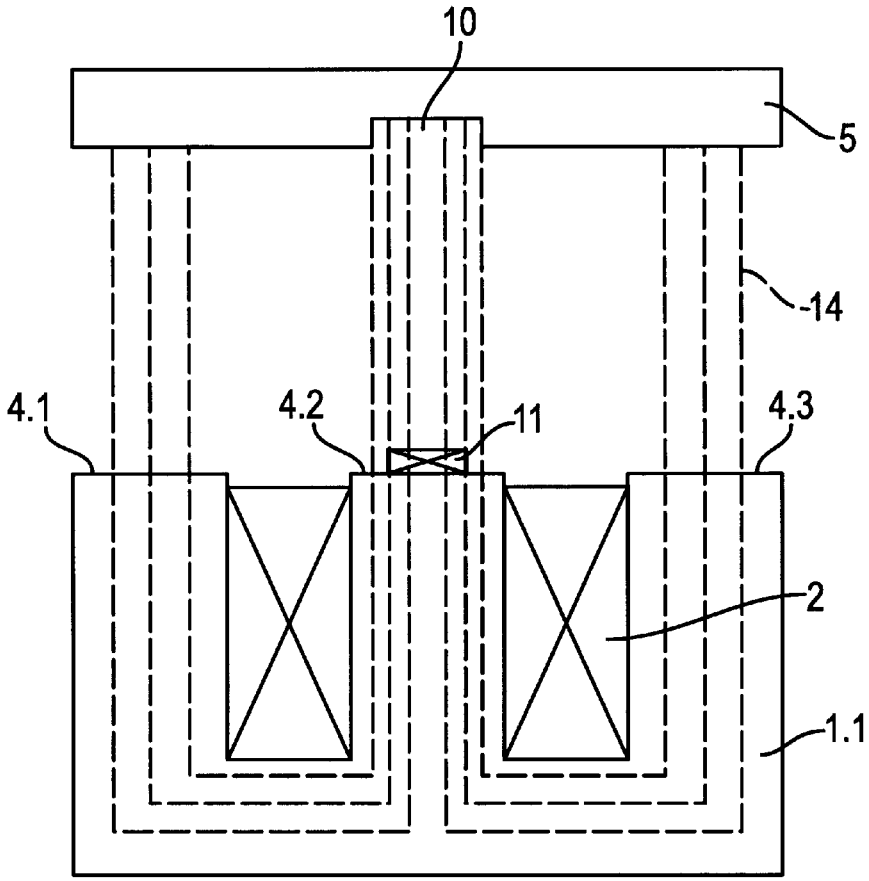
Figure 10:
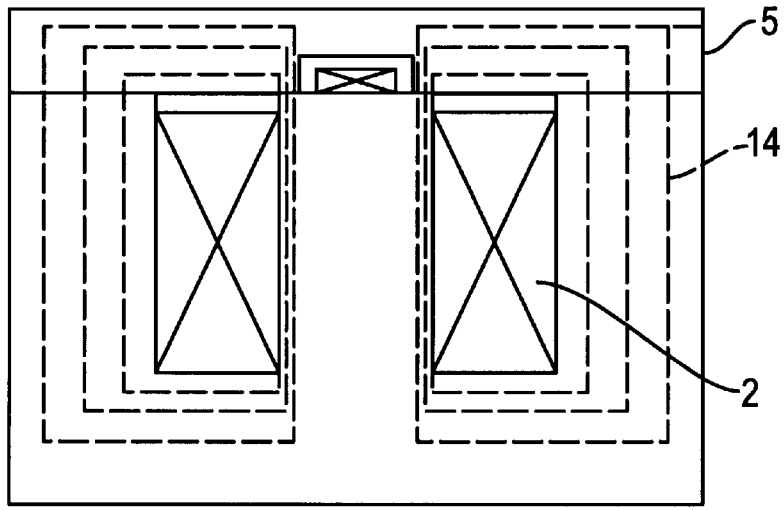

The invention will be described in further detail in conjunction with schematic drawings showing exemplary embodiments. Shown are:

FIG. 1, an electromagnetic actuator in section;

FIG. 2, on a larger scale, the course of the field lines in an air gap zone of the pole face in the case of large armature spacing;

FIG. 3, on a larger scale, the course of the field lines in an air gap zone in FIG. 2 of the pole face in the case of small armature spacing;

FIG. 4, schematically, the course of the current through a coil of the magnet as a function of time;

FIGS. 5 and 6, the course of the field lines for armature positions as shown in FIGS. 2 and 3 for a graduated air gap zone;

FIG. 7, an embodiment with two electromagnets acting in push-pull fashion on an armature;

FIG. 8, a circuit arrangement for forming a reference values;

FIGS. 9 and 10, a further embodiment with the course of field lines for different armature positions.

The electromagnetic actuator shown in FIG. 1 substantially comprises an electromagnet whose yoke 1 is provided with a coil 2. The coil 2 is connected to a controllable current supply 3.

The pole face 4 of the electromagnet is assigned an armature 5, which is connected to a transmission member 6 by a regulating element not shown in further detail here.

The view in FIG. 1 shows the actuator with the coil 2 rendered currentless in its first switching position, in which the armature 5 is held against a stop 8 by a restoring spring 7. If current is supplied to the coil 2, then the armature 5, under the influence of the magnetic force acting on it, is moved counter to the restoring force of the restoring spring 7 in the direction of the arrow 9, until it meets the pole face 4 and has reached its second switching position.

In the embodiment shown here, a recess 10 of predetermined depth is provided in the pole face 4 and forms an air gap zone, which occupies only a limited region of the pole face and in which a sensor 11 for detecting the magnetic field intensity or the magnetic flux is disposed, such as a Hall sensor. Via a corresponding signal line 12, the sensor 11 communicates with the controller of the controllable current supply, so that upon an approach of the armature 5 to the pole face 4, the position of the armature 5 is detected from the distortion in the magnetic flux that occurs in the region of the air gap zone, and the current to the coil 2 can be varied in controllable fashion as a function of the armature 5 to the pole face 4. This will be described in further detail below. Accordingly, can also be provided with a recess associated with the sensor on the pole face.

The air gap zone and the arrangement of the sensor 11 are shown on a larger scale in FIGS. 2 and 3. As can be seen from the drawings, the air gap zone has only a slight extent in the pole face and is surrounded on all sides by the yoke iron.

If the armature 5 is still shown at a relatively great spacing from the pole face 4, as shown in FIG. 2, then the air gap L.1 between the pole face 4 and the associated face of the armature 5 is so large that the field lines 14, regardless of the recess 10, pass uniformly through the pole face 4, so that the sensor 11, such as a Hall sensor, is penetrated in practically the same way by the flux.

However, as soon as the armature 5 upon its approach to the pole face 4 comes close to it, as shown in FIG. 3, and the resultant air gap L.2 attains approximately the extent of the depth d of the recess 10 in the pole face 4, then the air gap in the region of the sensor 11 is markedly larger, by the dimension d, than the air gap L.2 in the other regions between the pole face 4 and the approaching armature 5. As a result, with an increasing approach of the armature 5, the field is distorted, and the flux through the sensor 11 decreases in the air gap zone.

If a so-called Hall sensor is used, a marked drop in the Hall voltage close to the pole face occurs in accordance with the approach of the armature, so that from this a reliable signal for detecting the armature position is available, precisely in the immediate vicinity close to the pole face, shortly before the impact with the pole face. This also affords the possibility of reducing the current to the coil 2, for instance, such that with an increasing approach of the armature 5 to the pole face 4, the magnetic force acting on the armature 5 and thus the impact speed as well are reduced, since in accordance with the decrease in the magnetic forces acting on the armature 5 as it approaches the pole face 4, the influence of the restoring force of the restoring spring 7 increases. At the moment of contact of the armature 5 with the pole face 4, that is, when the armature is no longer in motion, the supply of current to the coil 2 can be controlled in such a way, being briefly increased, that the requisite magnetic force for securely holding the armature is available. After that, the current can be reduced again to the level of the so-called holding current.

This chronologically varying attenuation of the magnetic flux in the region of the defined air gap zone with its sensor 11 can furthermore be utilized for so-called impact recognition as well. As soon as the signal generated by the sensor 11 remains constant, a corresponding control signal for controlling current supply can be derived from it.

A so-called separation detection can also be done, specifically when the current to the holding magnet is turned off but the armature still "sticks". In the region of the sensor, upon detachment of the armature from the pole face, an "atypical" change in the residual magnetic flux can be ascertained. In this case, despite the movement away of the armature, a relative increase in the magnitude of the magnetic flux in this region can be ascertained, while the overall magnitude of the magnetic flux is decreasing. From this, a control signal for the control unit can be derived, for instance for a second, in that case "intercepting" magnet, in an embodiment as shown in FIG. 7.

If in controlling the current for the coil 2 it is desired that the actual magnitude of change in the field intensity be detected, optionally for other purposes besides indication and control, then an additional sensor 15 for detecting the unimpeded magnetic field intensity is disposed on the yoke 1 at a distance from the pole face 4, preferably on the back face 13 remote from the pole face 4; this sensor acts as a correction sensor or reference sensor and generates a reference signal. This affords the opportunity of putting the two signals in relation, for instance by finding a difference or a quotient between the unimpeded field intensity detected via the sensor 10 and that detected via the sensor 15, so as to attain the actual effective field attenuation, specifically regardless of the absolute magnitude of the magnetic flux intensity, which varies as the current level varies.

The position of the reference sensor 15 is not limited to the position shown in FIG. 1. It need merely be disposed in such a way that in the magnetic circuit that the positive displacement effect of the magnetic flux upon approach of the armature is more weakly pronounced than that of the actual measuring sensor. An arrangement is even possible in which the reference sensor is located together with the measuring sensor on a common substrate (such as a silicon chip). In that case, care need merely be taken, but structurally accommodating the sensors, that the measuring sensor undergo a more pronounced field attenuation than the reference sensor, for instance by having the measuring sensor protrude into a larger recess.

In FIGS. 5 and 6, analogous to the view of FIGS. 2 and 3, a modified embodiment for an air gap zone is shown. In this embodiment, in the pole face 4 there is a recess 10, which by means of a graduation 10.1 and 10.2 has two different depths d1 and d2. In this recess, a sensor 11 is disposed that has two discrete sensor zones 11.1 and 11.2, each assigned to a respective graduation 10.1 and 10.2. By way of example, the sensor 11 may be embedded in the recess 10 via a filler composition.

If the electromagnet is supplied with current when the associated armature 5 is still in the first switching position, then a magnetic flux develops that uniformly, that is, without distortion, penetrates the pole face 4, including the region of the air gap zone formed by the recess; this is shown in FIG. 5.

As soon as the armature 5, as shown in FIG. 6, approaches the pole face 4 and the air gap between the armature 5 and the pole face 4 decreases accordingly in size, the magnetic flux in the region of the air gap zone defined by the recess 10 becomes distorted; that is, the magnet lines "deflect" into the region of the pole face where the core material is fully available. As a result, in the region of the air gap zone defined by the recess, the magnetic flux penetrating this region is attenuated. The degree of attenuation depends, however, on the size of the air gap defined by the depth of the recess, so that in the region of the deeper graduation 10.2, a greater field attenuation occurs than in the shallower region 10.1, in which with the shallow depth of the recess the field course remains essentially unimpeded. Thus in this embodiment as well, the possibility exists by suitably interconnecting the sensor field 11.1 and the sensor field 11.2 and by forming a difference or quotient between the measurement values, of ascertaining the actually effective field attenuation and taking this into account for triggering the current supply, as has already been described above with regard to the sensor shown in FIG. 1.

By forming the difference, which can be done directly on the chip, or forming the quotient between the measurement signal and the reference signal, which in terms of exactness is even more favorable, a signal is generated that is independent of the actual field intensity and that directly represents a measure of the nearness, that is, the spacing of the armature. Thus the position can be regulated to a precise spacing and held there. This is valuable for instance in order to achieve very short strokes in actuators of inlet valves of internal combustion engines.

Another possibility of forming the reference value without using a second sensor exists in using the information about the current level. From the measured current level, it is then possible for instance with the aid of a characteristic curve, formula, or performance graph, to estimate the intensity of the magnetic flux. Since the actual (reference) field intensity in turn, however, depends on the armature position that is to be ascertained in this process, the process can be employed iteratively to increase the accuracy, although usually merely a single iteration loop suffices. Frequently, however, the iteration can be dispensed with, by using the most recently calculation position to ascertain the field intensity. This will be described in further detail below in conjunction with FIG. 8.

In FIG. 4, the course of the current flowing through the coil 2, which is predetermined by the control of the current supply 3, is schematically shown. As the graph shows, the during a time period t, the current increases up to a predeterminable level $I_{max}$; the predeterminable maximal current is dimensioned such that the magnetic force generated suffices to move the armature 5 in the direction of the pole face 4 counter to the force of the restoring spring 7. Since the force acting on the armature 5 increases with an increasing approach to the pole face 4, the current to be supplied can be kept constant or even lowered accordingly from time $T_1$ on, until after a predetermined time period $t_2$ elapses until the suspected impact of the armature on the pole face 4 at time $T_2$, the armature and the regulating element connected to it can be expected to have reliably reached its second switching position.

To enable holding the armature 5 in this second switching position over a predeterminable time period $t_h$, a markedly lesser holding force is needed, so that from time $T_2$ on, the level of the current supplied to the coil 2 is reduced to the amount $I_H$ by controlling the current supply 3, and energy can thus be saved. To improve energy economy, it is known for the current to be clocked during the time period $t_H$, as is shown in the graph. Once the holding time $t_H$ elapses, the current supply to the coil 2 is turned off at time $T_3$, so that the armature 5, under the influence of the force of the restoring spring 7, moves back into its first switching position. This form of controlling the current supply is known.

Since via the sensor 11 the approach of the armature 5 to the pole face 4 can now be detected, it is no longer necessary to wait for the previously estimated impact time $T_2$. On the contrary, it becomes possible, as a function of a predeterminable spacing, which by the extent of the field attenuation detected via the sensor 11, to reduce the current to the coil 2 early, for instance at time $T_4$, so that in the approach phase the magnet forces acting on the armature 5 can be reduced accordingly. The reduction can, as shown in FIG. 4, be reduced to $I_{min}$, that is, to a minimum level that just precisely assures a reliable contact of the armature 5 on the pole face. The course of current reduction over time from time $T_4$ on is selected schematically and arbitrarily here. Given suitable embodiment of the controller of the current supply 3, a shaping of the current course can be done in this region that is adapted to the prevailing conditions. The course of the current curve shown in dashed lines illustrates the current control as a function of time known from the prior art.

In FIG. 7, an electromagnetic actuator is shown as a practical exemplary embodiment, of a kind that can for instance be used to actuate gas exchange valves in a reciprocating piston engine.

In this embodiment, two electromagnets A and B are provided, which are equivalent in their structure to the magnet of FIG. 1, and thus identical components are identified by the same reference numerals here as there.

Once again, the armature 5 is disposed between the two spaced-apart electromagnets A and B, which are oriented with their pole faces 4 facing one another; the armature acts on a gas exchange valve via a transmission means, such as a thrust rod 6.

In this embodiment, two restoring springs 7.1 and 7.2 are provided, which are oriented counter to one another in terms of their force action, so that in the currentless state shown here, the armature 5, with equal spring prestressing, is located in the middle position between the two pole faces 4. The restoring spring 7.1 here urges the gas exchange valve 15 in the opening direction, while the restoring spring 7.2 urges the gas exchange valve in the closing direction.

The coils 2.1 and 2.2 of the two electromagnets are acted upon in alternation in terms of their current supply, again via a controllable current supply 3, in accordance with the given triggering conditions, so that the armature 5 in each case can be moved back and forth between the first switching position, defined by the contact on the pole face 4 of the electromagnet A, and its contact in the second switching position defined by the pole face 4 of the electromagnet B and can also be held there for the predetermined length of the holding time.

In the embodiment shown, both electromagnets A and B are provided with sensors 10 and 15 as described in conjunction with FIG. 1, so that upon the approach of the armature 5 to the pole face 4 of one of the two electromagnets, the impact speed of the armature to the pole face 4 can be reduced, so that in each case the armature 5 has a "soft" impact with the pole face.

The variation in the impact speed of the armature 5 on the respective pole face 4 can also be accomplished, in addition to varying the current course as has been described in conjunction with FIG. 4 as an exemplary embodiment, by triggering a so-called brake coil as well. To that end, in addition to the coil shown in FIGS. 1 and 5, respectively, of the respective electromagnet, a further coil is mounted on the yoke; this coil is provided with its own intrinsically closed current circuit, which can be opened and closed via a controllable switch element. This switch element can then be triggered via the controlling portion of the current supply device 3. When the switch element is closed, a current is generated as a consequence of the magnetic flux in the brake coil, and this current generates a magnetic flux oriented counter to the coil which has been supplied with current, so that the resultant magnetic force on the armature is also reduced.

Instead of this kind of "automatic" brake coil, it is also possible to connect such a brake coil to the controllable current supply 3 and via the current supply to build up a corresponding contrary magnetic flux.

FIG. 8 shows a circuit for forming a reference value without the provision of any additional sensor. To that end, the current value 20 either measured at the coil or predetermined by the controller is carried along with the travel information 21 to a performance graph 22, in which the magnetic flux intensity B (or some other value representing the magnetic flux) is stored in memory as a function of the travel (that is, the spacing or distance of the armature from the pole face) in the form of a table (or alternatively in the form of a mathematical formula). The output variable 23 from this performance graph is then carried as a reference signal for the magnetic flux to the quotient former 24. This quotient former is also supplied with the measurement signal 25 of the "positive displacement effect sensor" 11. The resultant quotient 26 is converted via a "linearizing unit" 27, into the actual travel information 28.The linearizing unit may be formed here with the aid of a table or a formula. The travel or spacing information can then be used to regulate the motion process. In addition, this position information can also be fed back (29) to the input of the arrangement described.

In FIGS. 9 and 10, analogously to the illustrations in FIGS. 2, 3 and FIGS. 5, 6, the embodiment of the defined air gap zone is shown for a different design of the electromagnet. As FIG. 9 shows, in this embodiment an electromagnet is provided with a yoke 1.1 that has an E-shaped cross section and is embodied such that it forms an elongated profile with open lateral ends or may also be embodied circularly. The yoke 1,1 thus in an elongated embodiment with an open end has three pole faces 4.1, 4.2, 4.3 or in a cylindrical version, it has an outer annular pole face 4.1 and an inner central pole face 4.2.

The coil 2 is placed in the recess enclosed by the legs of the yoke. The armature 5 is connected to a regulating element, not shown in detail here.

In the embodiment shown here, a sensor 11 for detecting the magnetic flux intensity is disposed on the pole face 4.2. In this embodiment, the sensor 11 as described above, may be disposed in a recess of pole face, or else it rests on the pole face 4.2, in which case a recess 10 must correspondingly be provided in the armature 5, as shown in FIGS. 9 and 10.

If the armature 5 is in its first switching position, as shown in FIG. 9, and current is then supplied to the coil 2, then the magnetic flux shown in FIG. 9, which fully penetrates the sensor 11, develops.

If the armature 5 approaches the pole faces 4, as shown in FIG. 10, then once again the field lines 14 of the magnetic flux are distorted in the manner shown; in the embodiment shown here, the magnet lines, developing as a toroidal form around the coil 2, become concentrated, with an increasing approach of the armature 5 to the pole face, on the outside of the middle leg of the yoke, and thus with an increasing approach of the armature 5 to the pole faces, the magnetic flux air gap zone defined by the sensor 11 with the recess 10 associated with it in the armature 5, decreases, and upon contact of the armature with the pole face, practically no magnetic flux is detected, depending on the extent of the air gap zone.

What is claimed is:

1. A process for recognizing motions, comprising the following steps:

(a) providing an electromagnet having a pole face;

(b) providing an armature movable into a first switching position remote from said pole face and into a second switching position in contact with said pole face;

(c) providing a current supply for energizing said electromagnet with a controllable current for generating a magnetic field to move said armature into said second switching position;

(d) providing a first air gap zone between the armature and the pole face; said first air gap zone having a first width defined by a distance between said armature and said pole face;

(e) providing a second air gap zone between the armature and the pole face; said second air gap zone having a second width defined by a distance between said armature and said pole face; said first and second widths simultaneously decreasing as the armature approaches the pole face, and, viewed simultaneously, said second width being at all times greater than said first width;

(f) positioning a sensor at said pole face within said second air gap zone;

(g) detecting, by said sensor, an attenuation of the magnetic field in said second air gap zone upon approach of said armature into said second position; and (h) generating a signal representing magnitudes detected by said sensor.

2. The process as defined in claim 1, further comprising the step of reducing the current, supplied to said electromagnet, as a function of an increasing attenuation of said magnetic field.

3. The process as defined in claim 1, wherein said second air gap zone is formed, at any given moment, simultaneously by two partial air gap zones having unlike air gap widths; and further wherein said detecting step comprises the step of simultaneously detecting said attenuation of said magnetic field in said two partial air gap zones.

4. The process as defined in claim 1, wherein said signal is a first signal; further comprising the steps of (i) providing an additional sensor;

(j) detecting an essentially undisturbed magnetic field at a location externally of said second air gap zone while said armature approaches said pole face;

(k) generating a second signal representing magnitudes detected by said additional sensor during step (j); and (l) comparing said first signal with said second signal for determining an actual magnitude of said attenuation of said magnetic field.

5. The process as defined in claim 1, comprising the following additional steps for detecting an actual magnitude of the attenuation of the magnetic field while the armature approaches the pole face:

(i) storing, in a performance graph, values representing the change in the magnetic field;

(j) picking up the values as a function of the position of the armature relative to the pole face; and (k) comparing the values obtained in step (j) with the signal obtained in step (h).

6. An electromagnetic actuator comprising (a) an electromagnet including a yoke; a coil supported by said yoke; and a pole face;

(b) an armature movable toward and away from said pole face into a first switching position remote from said pole face and into a second switching position in contact with said pole face;

(c) current supply means connected to said coil for energizing said electromagnet with a controllable current for generating a magnetic field to move said armature into said second switching position;

(d) a first air gap zone defined between said armature and said pole face; said first air gap zone having a first width defined by a distance between said armature and said pole face;

(e) means defining a second air gap zone between said armature and said pole face; said second air gap zone having a second width defined by a distance between said armature and said pole face; said first and second widths simultaneously decreasing as the armature approaches the pole face; said second width, as viewed simultaneously with said first width; being at all times greater than said first width;

(f) a sensor disposed at said pole face within said second air gap zone for emitting a signal representing an attenuation of the magnetic field in said second air gap zone upon approach of said armature into said second switching position; and (g) control means connected to said sensor and said current supply means for controlling the current supplied to said coil as a function of said signal.

7. The electromagnetic actuator as defined in claim 6, wherein said means defining said second air gap zone comprises a recess provided in said pole face; said sensor being disposed in said recess.

8. The electromagnetic actuator as defined in claim 6, wherein said recess has a stepped bottom, whereby said second recess has a first portion having a first depth and a second portion having a second depth; said sensor being disposed in said first portion; further comprising an additional sensor disposed in said second portion for detecting the magnetic field intensity therein.

9. The electromagnetic actuator as defined in claim 6, wherein said means defining said second air gap zone comprises a recess provided in a surface of said armature oriented toward said pole face; said sensor being disposed on said pole face in alignment with said recess.

* * * * *